United States Patent [19]

Oka

[11] Patent Number: 5,005,838

[45] Date of Patent: Apr. 9, 1991

[54] GOLF BALL

[75] Inventor: Kengo Oka, Kobe, Japan

[73] Assignee: Sumitomo Rubber Industries, Ltd., Hyogo, Japan

[21] Appl. No.: 517,732

[22] Filed: May 2, 1990

[30] Foreign Application Priority Data

May 9, 1989 [JP] Japan ..... 1-115856

[51] Int. Cl.[5] ..... A63B 37/14

[52] U.S. Cl. ..... 273/232; 40/327

[58] Field of Search ..... 273/232; 40/327

[56] References Cited

U.S. PATENT DOCUMENTS

| | | | |
|---|---|---|---|
| 922,773 | 5/1909 | Kempshall | 273/232 |
| 1,716,435 | 6/1929 | Fotheringham | 273/232 |

FOREIGN PATENT DOCUMENTS

| | | | |
|---|---|---|---|
| 60-92780 | 5/1985 | Japan | 273/232 |
| 60-129966 | 8/1985 | Japan | 273/232 |
| 61-154683 | 7/1986 | Japan | 273/232 |
| 61-180056 | 11/1986 | Japan | 273/232 |
| 1268580 | 10/1989 | Japan | 273/232 |
| 2102681 | 4/1990 | Japan | 273/232 |

*Primary Examiner*—George J. Marlo

*Attorney, Agent, or Firm*—Birch, Stewart, Kolasch & Birch

[57] ABSTRACT

The present invention is directed to a golf ball wherein a projection is circularly formed on the bottom of a dimple so as to increase the drag coefficient of the golf ball, whereby the golf ball can be prevented from flying a long distance.

Supposing that the largest diameter of said projection is D1, the diameter of said dimple is D2, and $L=D1/D2$, an equation of $0.1 \leqq L \leqq 0.9$ is determined;

supposing that the height of said projection 11 is H1, the virtual greatest depth of said dimple is H2, and $K=H1/H2$, an equation of $0.6 \leqq K \leqq 1.0$ is determined; and the number of dimples ranges from 250 to 600.

1 Claim, 5 Drawing Sheets

GOLF BALL

BACKGROUND OF THE INVENTION

1. Field of the Invention

The present invention relates to a golf ball which flies a short distance and more particularly, to a golf ball which is prevented from flying a long distance owing to the configuration of dimples formed so that the drag coefficient thereof is high.

2. Description of the Related Art

As is generally known, dimples are formed on a golf ball so as to increase its flight by increasing its lift coefficient and decrease its drag coefficient while the golf ball is flying.

In order to meet golfers' desire to play golf with a golf ball which flies a long distance, researches including the improvement of the configuration of a dimple have been made to provide such a golf ball.

Recently, there is a growing demand for the manufacture of a golf ball which is prevented from flying a long distance so that the following two problems can be solved.

One is that in a small practicing ground, a golf ball driven by a golfer passes through the net of the practicing ground.

The other is that a golfer desires to play golf with a club, capable of flying a golf ball a long distance, such as a driver even in a golf course short from a tee ground to a green.

The following two proposals are made to reduce the flight of a golf ball: According to Japanese Patent Laid-Open Publication No. 60-92780, the mixing ratio of materials of a golf ball is altered to reduce its restitution coefficient. That is, the golf ball is prevented from flying a long distance by reducing its initial speed. According to Japanese Patent Laid-Open Publication No. 61-154683, projections are formed on the surface of a golf ball so as to increase its drag coefficient while it is flying. Thus, it can be prevented from flying a long distance.

The flight of the golf ball in accordance with Japanese Patent Laid-Open Publication No. 60-92780 is approximately 5% shorter than known golf balls. Therefore, the golf ball can be prevented from passing through the net of a practicing ground. But the flying distance of the golf ball is not so short as to allow a golfer to use a driver in a short golf course. Thus, there is room for further researches.

The golf ball having projections formed thereon according to Japanese Patent Laid-Open Publication No. 61-154683 is preferable in that the flying distance of the golf ball is much shorter than known golf balls. But the configurations of dimples are not uniform because of the disadvantage caused by molding of the golf ball and the manufacturing process, which leads to the nonuniform flying performance of the golf ball and the unfine outer appearance.

A golf ball is molded as follows: A male die serving as a master die is manufactured and the male die is necessary for manufacturing semispherical upper and lower female dies. A golf ball is molded by the two female dies. Most of golf balls commercially available have dimples 1A as shown in FIG. 8. A female die 2 having projection 1B as shown in FIG. 9 is required to be manufactured to form the dimples 1A.It is necessary to manufacture a male die 3 having dimples 1C serving as a master die as shown in FIG. 10 in order to manufacture the female die 2. The dimples 1C of the male die 3 having the dimples 1C can be formed with a comparative ease and in a small error by cutting a plain semispherical metallic material with an end mill of an appropriate configuration.

In order to manufacture the golf ball having the dimple 4A, according to Japanese Patent Laid-Open Publication No. 61-154683, as shown in FIG. 11, it is necessary to manufacture a female die 5 having the dimple 4B as shown in FIG. 12. It is necessary to manufacture a male die 6 having projections 4C as shown in FIG. 13 as a master die in order to manufacture the female die 5.

It is necessary to prepare a large-scale electric discharge machining equipment so as to form the male die 6 having the projections 4C. It is expensive to manufacture the male die 6 by the electric discharge machining equipment and further, the configurations of dimples are nonuniform. Consequently, the flight performance of the golf ball having the projections is nonuniform. Further, as described previously, since the golf ball is molded in combination of the semispherical upper and lower dies, a burr is necessarily formed on the seam line between upper and lower dies, namely, on the parting line of the golf ball. In grinding the burr formed on the golf ball having the projections 4A as shown in FIG. 11, the dimples 4A contacts with the grinding stone. Consequently, the burr cannot be abraded sufficiently and dimples adjacent to the parting line are partly worn away, i.e., the dimples are deformed. Accordingly, the golf ball having the projections does not look externally fine and the flight performance thereof is nonuniform.

SUMMARY OF THE INVENTION

The present invention has been made with a view to substantially solving the above-described disadvantages.

It is an object of the present invention to provide a golf ball which is uniform in its flight performance and looks fine externally owing to the configurations of dimples formed to prevent the golf ball to fly a long distance and an easy manufacturing of the dimples, the configurations of which are uniform.

In accomplishing this and other objects, in a golf ball in accordance with the present invention, a projection is circularly formed on the bottom of a dimple so as to increase the drag coefficient of the golf ball. Thus, the golf ball can be prevented from flying a long distance.

More specifically, according to the present invention, a projection is circularly formed on the bottom of the dimple of the golf ball. Supposing that the largest diameter of the projection is D1, the diameter of the dimple circularly formed is D2, and $L = D1/D2$, an equation of $0.1 \leqq L \leqq 0.9$ is determined.

Supposing that the height of the projection is H1, the virtual greatest depth of the dimple is H2, and $K = H1/H2$, an equation of $0.6 \leqq K \leqq 1.0$ is determined and the number of dimples ranges from 250 to 600.

The projection formed on the bottom of the dimple allows the drag coefficient of the golf ball to be increased when it is flying. Accordingly, the golf ball can be prevented from flying a long distance. This is clarified by the result of experiments to be described later.

Similarly to known dimples as shown in FIGS. 8 through 10, in forming the dimple with the projection formed on the bottom thereof, a male die serving as a master die can be manufactured by an end mill. The male die can be easily manufactured and the configurations of dimples can be formed uniformly thereby with a high accuracy. Thus, the golf ball can be prevented from flying a long distance and further, the flying performance thereof can be uniform.

A burr formed on the parting line of the golf ball having the projection formed on the bottom of the dimple can be ground without abrading away the dimple. Therefore, the golf ball looks fine and its flight performance can be uniformalized.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
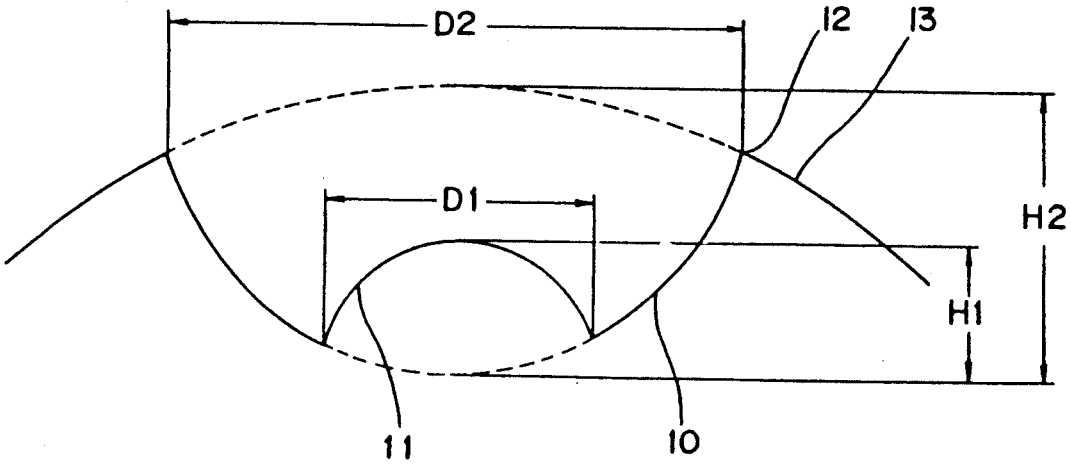
FIG. 1 is a partial enlarged view showing the configuration of a golf ball in accordance with the present invention.

Before the description of the present invention proceeds, it is to be noted that like parts are designated by like reference numerals throughout the accompanying drawings.

Referring now to the drawings, there is shown in FIG. 1 part of a golf ball in accordance with a preferred embodiment of the present invention. In FIG. 1, a dimple shown in a sectional view is indicated by reference numeral 10; a projection circularly formed on the bottom of the dimple 10 is denoted by reference numeral 11; the outer circumferential edge of the dimple 10 is indicated by reference numeral 12; and the spherical surface of the golf ball is represented by reference numeral 13.

The dimple 10 is formed as part of a circle. The projection 11 integrated with the dimple 10 is also part of a circle, the center of which is the lowest point of the dimple 10. It is necessary to form the projection 11 in an appropriate size. If the projection 11 is too small, the projection 11 is not so effective for preventing the golf ball from flying a long distance. If the projection 11 is so large as to project from the spherical surface of the golf ball, it is difficult to remove a burr formed on the parting line thereof. According to experiments, the preferable size of the projection 11 is determined in the following range:

Supposing that, referring to FIG. 1, the largest diameter of the projection 11 is D1, the diameter of the dimple 10 circularly formed is D2, and $L=D1/D2$, an equation of $0.1 \leqq L \leqq 0.9$ is determined.

Supposing that the height of the projection 11 is H1, the virtual greatest depth of the dimple 10 is H2, and $K=H1/H2$, an equation of $0.6 \leqq K \leqq 1.0$ is determined.

Figure 2:
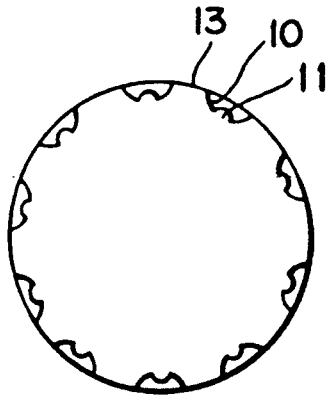
FIG. 2 is a schematic drawing showing a golf ball in accordance with the present invention.

As schematically shown in FIG. 2, many dimples 10 are formed on the spherical surface of the golf ball. Needless to say, dimples 10 of various diameters can be formed. According to the present invention, the total number of dimples formed on the golf ball ranges from approximately 250 to 600.

Figure 3:
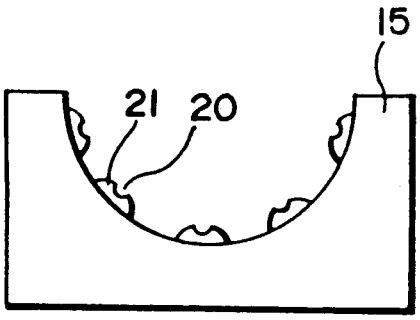
FIG. 3 is a schematic drawing showing a female die for molding the golf ball shown in FIG. 2.
Figure 4:
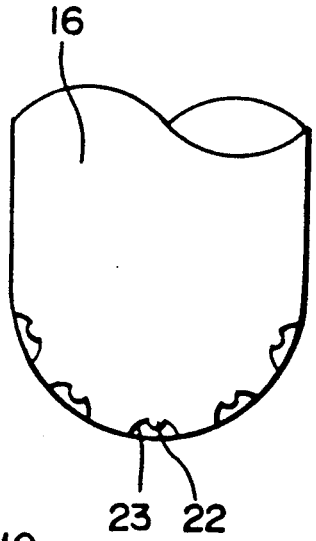
FIG. 4 is a schematic drawing showing a male die for forming the female die shown in FIG. 3.

The golf ball 10 having the projections 11 is formed in combination of two semispherical female dies 15 as shown in FIG. 3. A male die 16 as shown in FIG. 4 is manufactured to make female dies 15. In order to form the dimple 10 having the projection 11, a projection 21 having a concave 20 on the top thereof is formed on the surface of the female die 15. In order to form the projection 21 on the surface of the female die 15, a concave 23 having a projection 22 is formed on the bottom of the male die 16. Similarly to a known male die for forming a dimple, the concave 23 of the male die 16 is formed by an end mill.

In order to form the projection 11 whose $(L)=D1/D2$ is less than 0.1 or or more than 0.9, it is necessary to sharpen an end mill, which in practice is impossible. This is the reason the value of (L) is set as above, namely, $0.1 \leqq L \leqq 0.9$.

If $(K)=H1/H2$ is less than 0.6, i.e., if the projection 11 is too small, the projection 11 is not so effective for preventing the golf ball from flying a long distance. If (K) is more than 1.0, the male die 16 cannot be manufactured by the end mill and as such, it is necessary to manufacture the male die 17 by an electric discharge machining. Anotherr disadvantage caused in K is more than 1.0, i.e., if the projection 11 projects from the dimple 10, the projections formed on the bottoms of dimples arranged adjacent to the parting line are abraded away in grinding the burr formed on the parting line of the golf ball. Consequently, the configurations of the dimples become nonuniform, which causes the nonuniformity of the flight performance of the golf ball. In addition, the top portion of the projection 11 which projects from the spherical surface of the golf ball is repeatedly hit by clubs, which leads to the wear-away thereof. This is the reason the value of (K) is set as above, namely, $0.6 \leqq L \leqq 1.0$.

If the number of dimples is less than 250 or more than 600, as well known, the golf ball does not have a sufficient lift when it is flying, i.e., the golf ball flies low in the air.

In order to test the flight performance and symmetry of the golf ball in accordance with the present invention, the following three kinds of golf balls are prepared: Twelve golf balls according to the present invention; twelve known golf balls; and twelve golf balls having (K) values different from the (K) value according to the present invention. The numerical values of these golf balls are shown in Table 1.

Figure 6:
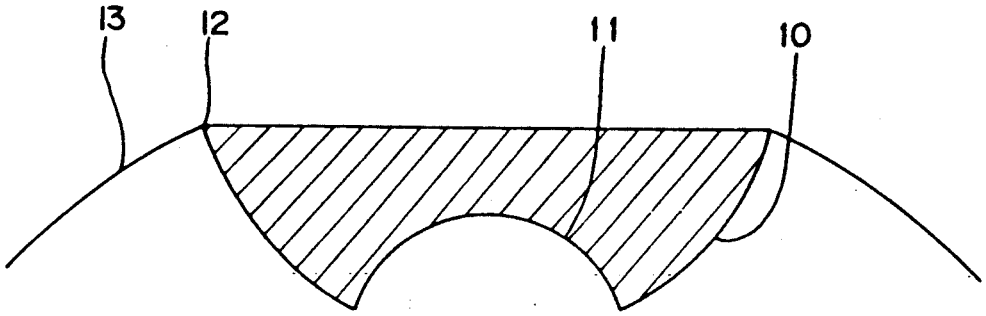
FIG. 6 is a partial enlarged view showing a portion corresponding to the volume of a dimple formed on a golf ball in accordance with the present invention.
Figure 5:
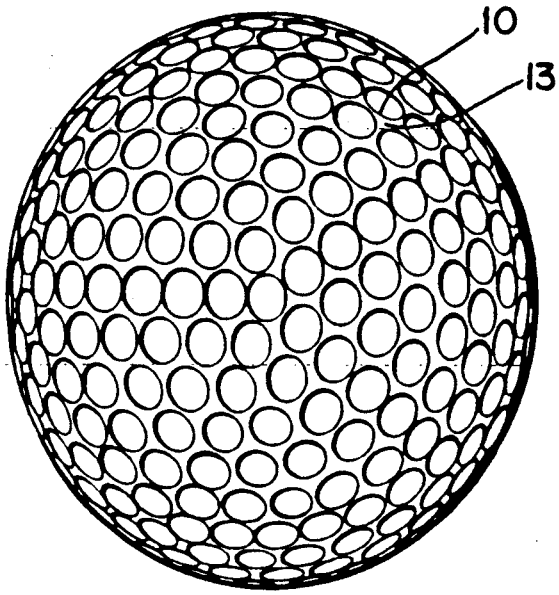
FIG. 5 is a front view showing the dimple pattern of golf balls according to embodiments 1 and 2 of the present invention and comparisons 1, 2, and 3.

As shown in FIG. 1, golf balls in accordance with the present invention are represented by embodiments 1 and 2. Known golf balls are denoted by comparison 1. Golf balls having (K) values different from the (K) value in accordance with the present invention are indicated by comparisons 2 and 3. As shown in FIG. 5, dimples of these golf balls are arranged by dividing each of the spherical surfaces of the golf balls into twenty spherical triangles corresponding to the faces of an icosahedron. The number of dimples are all 392. The dimple volume described in Table 1 means the volume of the portion shown by cross-latching in FIG. 6 and was calculated by a surface roughness tester. The total dimple volume which is uniformly 320±2 $mm^3$ is obtained by adding all of the dimple volumes to each other. Each of the golf balls comprises a balata cover and wound threads. Compressions were 95±2 each.

TABLE 1

| | D2 (mm) | D1 (mm) | L (D1/D2) | H1 (mm) | H2 (mm) | K (H1/H2) | dimple volume ($mm^3$) | total dimple volume ($mm^3$) |
|---|---|---|---|---|---|---|---|---|
| embodiment 1 | 3.6 | 1.8 | 0.5 | 0.17 | 0.28 | 0.6 | 0.82 | 321 |
| embodiment 2 | 3.6 | 1.8 | 0.5 | 0.24 | 0.29 | 0.8 | 0.81 | 318 |
| comparison 1 | 3.6 | | 0 | | 0.24 | 0 | 0.82 | 321 |
| comparison 2 | 3.6 | 1.8 | 0.5 | 0.13 | 0.27 | 0.5 | 0.82 | 321 |
| comparison 3 | 3.6 | 1.8 | 0.5 | 0.36 | 0.33 | 1.1 | 0.81 | 318 |

Each of the golf balls of embodiment 1 has a projection on the dimple bottom so that the (K) value is 0.6. Each of the golf balls of embodiment 2 has a projection on the bottom of the dimple thereof so that the (K) values is 0.8.

Each of the golf balls of comparison 1 has no projection on the bottom of the dimple thereof. Each of the golf balls of comparison 2 has a projection on the bottom of the dimple thereof so that the (K) value is 0.5. Each of the golf balls of comparison 3 has a projection on the bottom of the dimple thereof so that the (K) value is 1.1.

As shown in Table 1, the respective golf balls except comparison 1 have an (L) value of 0.5.

The concave 23 of the male die 16 for molding the golf balls of embodiments 1, 2, comparisons 1, and 2 through the female die 15 are formed by end mills. Therefore, the configurations of the dimples of these golf balls are uniform and it is easy to abrade burrs formed on the parting lines of these golf balls. Thus, the golf balls look fine. The configurations of the dimples of the golf balls of comparison 3 are not uniform because the male die for molding the golf balls of comparison 3 is manufactured by an electric discharge machining. Further, the burrs formed on the golf balls are not favorably abraded away. Further, the projections formed on the bottoms of the dimples adjacent to the parting line thereof are worn away in grinding the burrs. Thus, the golf balls do not look fine externally.

EXPERIMENT 1

A flight performance test was conducted on the golf balls of embodiments 1, 2, comparisons 1, 2, and 3. Golf balls were hit by a swing robot manufactured by True Temper Inc. at a head speed of 45 m/s. The kind of club used was a driver.

The test result is shown in Table 2. The number of golf balls used in the test was 12 for each kind of golf ball. The numerical value of each kind of golf ball shown in Table 2 was obtained by taking the average of the numerical values of the 12 golf balls which were hit by the driver as described above. The wind was following at a speed of 1.5~3.0 m/s. The drive angle was approximately 9.7° and the rpm of the golf ball to which a spin was given was approximately 3,600 each. The above-described drive angle and the rpm are normal for a golfer who drives a golf ball at a head speed of 45 m/s.

Trajectory height shown in Table 2 is an elevation angle which the ball driving point makes with the golf ball when it is at the maximum height.

TABLE 2

| | drive angle | spin (rpm) | carry (yard) | run (yard) | total (yard) | trajectory height | flight duration (second) |
|---|---|---|---|---|---|---|---|
| embodiment 1 (K = 0.6) | 9.63° | 3610 | 187 | 11 | 198 | 13.30° | 5.6 |
| embodiment 2 (K = 0.8) | 9.82° | 3520 | 179 | 10 | 189 | 13.21° | 5.7 |
| comparison 1 (K = 0) | 9.65° | 3580 | 217 | 11 | 228 | 13.30° | 5.7 |
| comparison 2 (K = 0.5) | 9.70° | 3550 | 208 | 14 | 222 | 13.19° | 5.8 |
| comparison 3 (K = 1.1) | 9.89° | 3500 | 170 | 12 | 182 | 13.38° | 5.7 |

Figure 7:
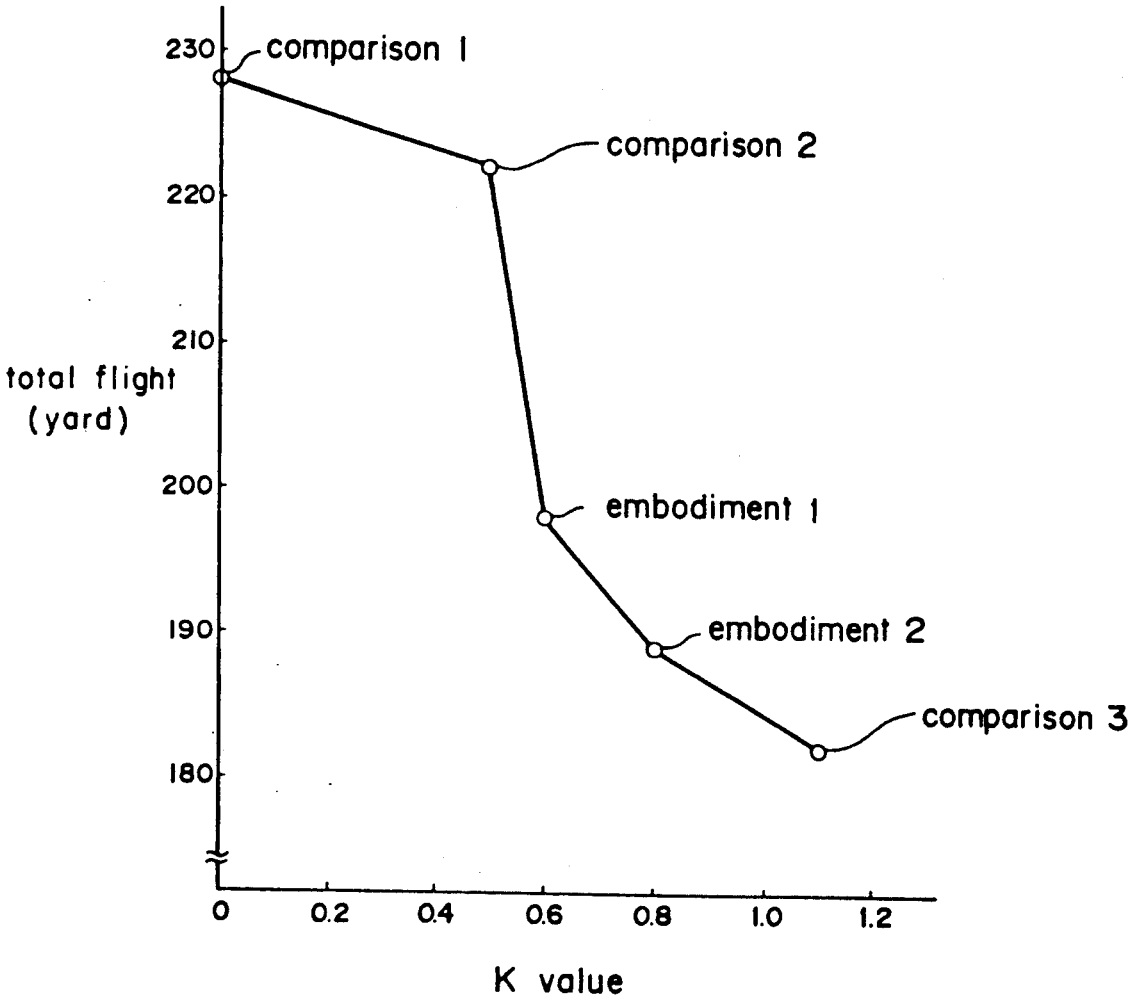
FIG. 7 is a diagrammatic view showing the result of flight tests of the golf balls in accordance with the embodiments 1 and 2 of the present invention and the comparisons 1, 2, and 3.
Figure 8:
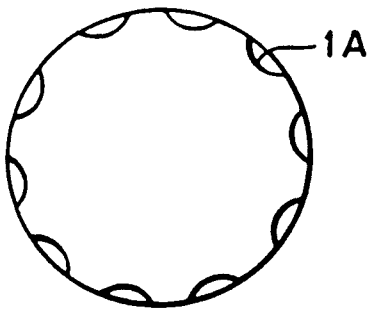
FIG. 8 is a schematic drawing of a known golf ball having dimples.
Figure 9:
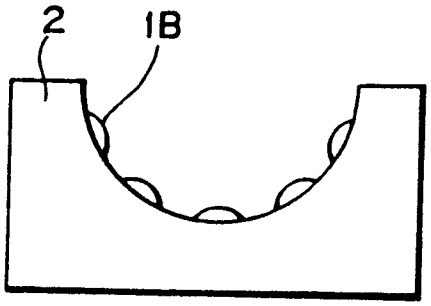
FIG. 9 is a schematic drawing showing a female die for molding the golf ball shown in FIG. 8.
Figure 10:
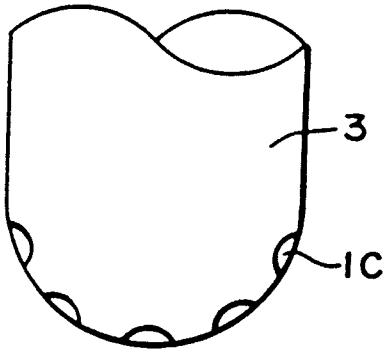
FIG. 10 is a schematic drawing showing a male die for forming the female die shown in FIG. 9.
Figure 11:
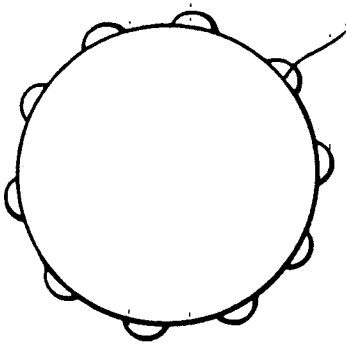
FIG. 11 is a schematic drawing of a known golf ball having projections.
Figure 12:
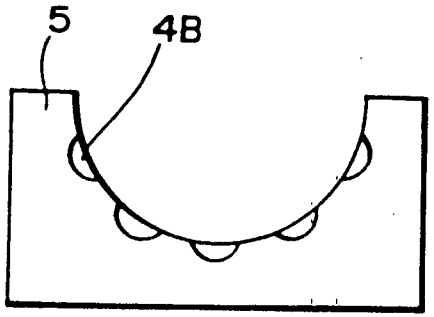
FIG. 12 is a schematic drawing showing a female die for molding the golf ball shown in FIG. 11.
Figure 13:
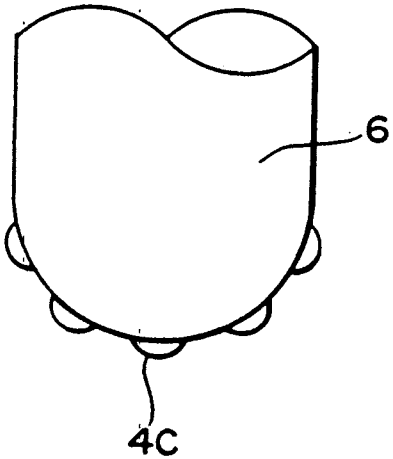
FIG. 13 is a schematic drawing showing a male die for forming the female die shown in FIG. 12.

The relationship between (K) value and the total flying distance is as shown in the graph of FIG. 7. As shown in the graph, the higher (K) value is, the shorter the total flight is and the total flying distance becomes rapidly short with the increase of (K) from 0.5.

That is, as shown in Table 2, the flight of the comparison 2-golf ball whose (K) value is 0.5 is only 3% shorter than the comparison 1-golf ball whose (K) value is 0. The total flight of the comparison 3-golf ball whose (K) value is 1.1 is much shorter than the golf balls of the comparisons 1 and 2, however, the dimples thereof does not look fine because these dimples are manufactured by the electric discharge machining as described previously. Therefore, the flight performance of the golf of comparison 3 is nonuniform.

The total flights of the comparison 1-golf ball whose (K) value is 0.6 and the comparison 2-golf ball whose (K) value is 0.8 are shorter than the comparison 1-golf ball whose (K) value is 0 by 13% and 17%, respectively.

As described previously, the head speed was 45 m/s in the test. Considering that a golfer drives a golf ball at a speed of 40~45 m/s, the golfer can hit the golf balls of embodiments 1 and 2 with a driver on a tee ground in a short golf course less than 200 yards as apparent from Table 2.

EXPERIMENT 2

A symmetry test was conducted on the golf balls of embodiments 1, 2, and comparison 3 in order to investigate the flight performances thereof. Golf balls were hit by a swing robot manufactured by True Temper Inc. at a head speed of 48.8 m/s. The kind of club used was a driver.

The test result is shown in Table 3.

A seam drive shown in Table 3 means a method for driving a golf ball with the line connecting the north pole and the south pole with each other being the rotational axis of a back spin supposing that the parting line of the golf ball is the equator. A pole drive shown in Table 3 means a method for driving the golf ball with the line at a right angle with the rotational axis of the seam drive at the center of the golf ball being the rotational axis of the back spin.

The numerical value of each kind of golf ball shown in Table 3 were obtained by taking the average of the numerical of 20 golf balls each hit by the pole drive and the seam drive. It was windless during the test.

TABLE 3

| | drive angle | spin (rpm) | carry (yard) | run (yard) | total (yard) | trajectory height | flight duration (second) |
|---|---|---|---|---|---|---|---|
| embodiment 1 (K = 0.6) | | | | | | | |
| pole drive | 9.01° | 3580 | 241 | 14 | 255 | 13.33° | 6.1 |
| seam drive | 9.10° | 3540 | 243 | 11 | 254 | 13.40° | 6.1 |
| embodiment 2 (K = 0.8) | | | | | | | |
| pole drive | 9.04° | 3610 | 230 | 12 | 242 | 13.26° | 6.2 |
| seam drive | 8.99° | 3570 | 229 | 15 | 244 | 13.21° | 6.1 |
| comparison 3 (K = 1.1) | | | | | | | |
| pole drive | 9.05° | 3570 | 225 | 9 | 234 | 13.45° | 6.4 |
| seam drive | 9.01° | 3580 | 210 | 13 | 223 | 13.01° | 5.9 |

As shown in Table 3, comparing the embodiment 1-golf ball whose (K) value is 0.6 and the embodiment 2-golf ball whose (K) value is 0.8 with each other, there are little difference between the pole drive and the seam drive in the flights, trajectory heights, and duration of flights thereof. It can be said that the flight performances of these golf balls are uniform. On the other hand, in the comparison 3-golf ball whose (K) value is 1.1, there are much difference between the pole drive and the seam drive in the flights, trajectory heights, and duration of flights thereof. It can be said that the flight performances of the golf balls of comparison 3 are nonuniform. This is caused by the unfavorable removal of the burr formed on the parting line of the golf ball of comparison 3 and the wear-away of dimples arranged adjacent to the parting line. Thus, the dimple is uneffective for the flight performance of the golf ball in the seam drive and as such, the lift coefficient of the golf ball is reduced, which in turn lowered its trajectory height Although the present invention has been fully described in connection with the preferred embodiments thereof with reference to the accompanying drawings, it is to be noted that various changes and modifications are apparent to those skilled in the art. Such changes and modifications are to be understood as included within the scope of the invention as defined by the appended claims unless they depart therefrom.

What is claimed is:

1. A golf ball, which flies a short distance having a projection circularly formed on the bottom of a dimple circularly formed, wherein supposing that the largest diameter of said projection is D1, the diameter of said dimple is D2, and $L=D1/D2$, an equation of $0.1 \leqq L \leqq 0.9$ is determined;

supposing that the height of said projection 11 is H1, the virtual greatest depth of said dimple is H2, and $K=H1/H2$, an equation of $0.6 \leqq K \leqq 1.0$ is determined; and the number of dimples ranges from 250 to 600.

* * * * *